US011721536B2

(12) United States Patent
Ueda et al.

(10) Patent No.: US 11,721,536 B2
(45) Date of Patent: Aug. 8, 2023

(54) MASS SPECTROMETER

(71) Applicant: SHIMADZU CORPORATION, Kyoto (JP)

(72) Inventors: Manabu Ueda, Kyoto (JP); Tomohito Nakano, Kyoto (JP); Yuki Tanaka, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 300 days.

(21) Appl. No.: 17/291,824

(22) PCT Filed: Nov. 29, 2018

(86) PCT No.: PCT/JP2018/044042
§ 371 (c)(1),
(2) Date: May 6, 2021

(87) PCT Pub. No.: WO2020/110264
PCT Pub. Date: Jun. 4, 2020

(65) Prior Publication Data

US 2021/0391164 A1 Dec. 16, 2021

(51) Int. Cl.
*H01J 49/04* (2006.01)
*H01J 49/06* (2006.01)
(Continued)

(52) U.S. Cl.
CPC ..... *H01J 49/0431* (2013.01); *H01J 49/063* (2013.01); *H01J 49/165* (2013.01); *H01J 49/24* (2013.01)

(58) Field of Classification Search
CPC ..... H01J 49/04; H01J 49/24; H01J 49/063; H01J 49/067; H01J 49/165; H01J 49/0431
See application file for complete search history.

(56) References Cited

U.S. PATENT DOCUMENTS 6,423,965 B1 * 7/2002 Hashimoto ..... H01J 49/04 250/292
2001/0054688 A1 12/2001 Waki
(Continued)

FOREIGN PATENT DOCUMENTS

JP 7-142025 A 6/1995

OTHER PUBLICATIONS

Invitation pursuant to Rule 62a(1) EPC and Rule 63(1) EPC dated Nov. 5, 2021 for the corresponding European Patent Application No. 18941205.9.
(Continued)

*Primary Examiner* — David E Smith
*Assistant Examiner* — Hsien C Tsai
(74) *Attorney, Agent, or Firm* — Sughrue Mion, PLLC

(57) ABSTRACT

A single type quadrupole mass spectrometer equipped with an ion source by the ESI method, which is a small device including a vacuum pump having a relatively small evacuation speed. The internal diameter of a desolvation tube for introducing ions from an ionization chamber into a first intermediate vacuum chamber is set to 0.4 mm φ, which is large for a small mass spectrometer. The evacuation speed of a rotary pump is determined so that the product of the cross-sectional opening area of the desolvation tube and the pressure in the first intermediate vacuum chamber falls within a range of 15 to 40 $mm^2 \cdot Pa$. This can ensure high detection sensitivity and reduce clogging of the desolvation tube due to droplets. Since the pressure in the first intermediate vacuum chamber does not need to be increased more than necessary, a small rotary pump having a small evacuation speed can be used.

18 Claims, 2 Drawing Sheets

(51) Int. Cl.
*H01J 49/16* (2006.01)
*H01J 49/24* (2006.01)

(56) References Cited

U.S. PATENT DOCUMENTS

| | | | |
|---|---|---|---|
| 2011/0186732 | A1 | 8/2011 | Yasuno |
| 2012/0138790 | A1 | 6/2012 | Wright et al. |
| 2013/0092835 | A1 | 4/2013 | Mukaibatake et al. |
| 2016/0093480 | A1 | 3/2016 | Gordon et al. |
| 2016/0111266 | A1 | 4/2016 | Gordon et al. |

OTHER PUBLICATIONS

Extended European Search Report dated Mar. 22, 2022 in European Application No. 18941205.9.

"Acquity QDa Mass Detector", [online], Nihon Waters K. K., [Searched on Aug. 8, 2018], Internet <URL:http://www.waters.com/waters/ja_JP/ACQUITY-QDa-Mass-Detector-for-Chromatographic-Analysis/nav.htm?locale=ja_JP&cid=134761404>, obtained through the Internet on Apr. 26, 2021.

Written Opinion for PCT/JP2018/044042, dated Feb. 5, 2019.

International Search Report for PCT/JP2018/044042, dated Feb. 5, 2019.

* cited by examiner

MASS SPECTROMETER

CROSS REFERENCE TO RELATED APPLICATIONS

This application is a National Stage of International Application No. PCT/JP2018/044042 filed Nov. 29, 2018.

TECHNICAL FIELD

The present invention relates to a mass spectrometer, and more particularly, a mass spectrometer in which an ion source is an atmospheric pressure ion source and a mass separator is a quadrupole mass filter. The mass spectrometer according to the present invention is particularly suitable for a liquid chromatograph mass spectrometer (LC-MS) in which the mass spectrometer is connected to the column outlet of a liquid chromatograph (LC).

BACKGROUND ART

A mass spectrometer used as a detector of a liquid chromatograph (LC) usually includes an atmospheric pressure ion source utilizing an ionization method such as electrospray ionization (ESI), atmospheric pressure chemical ionization (APCI), or atmospheric pressure photoionization (APPI) in order to ionize a component in a liquid sample. In such a mass spectrometer, ions generated under an atmospheric pressure need to be transported to an analysis chamber in which a mass separator such as a quadrupole mass filter is disposed. In order to maintain the inside of the analysis chamber at a high vacuum, a multi-stage differential evacuation system is adopted in which a plurality of intermediate vacuum chambers are provided between the ionization chamber and the analysis chamber. In such a mass spectrometer, since a plurality of sections having different pressures are connected in series, the ion path through which ions pass from the ion source to the ion detector tends to be longer, and the size of the mass spectrometer tends to increase.

In recent years, there has been a strong demand for downsizing of mass spectrometers, particularly in LC-MS. This is because, in LC-MS systems, mass spectrometers are often used in place of other types of LC detectors, such as photodiode array (PDA) detectors, and it is convenient for system installation space that another detector unit such as a PDA detector and the unit of the mass spectrometer used as an LC detector have the same or similar sizes. Therefore, the mass spectrometers used for LC-MS, in particular, single type quadrupole mass spectrometers, have been developed to be considerably smaller than conventional general quadrupole mass spectrometers (see Non-Patent Literature 1).

What is important when downsizing an atmospheric pressure ionization quadrupole mass spectrometer is to shorten the ion path from the ion source to the ion detector, and to downsize the vacuum pump that evacuates the intermediate vacuum chamber and the analysis chamber. In general, downsizing of a mass spectrometer is realized by downsizing some elements constituting the mass spectrometer and appropriately changing control parameters such as applied voltage accordingly. For example, in the mass spectrometers described in Patent Literatures 1 and 2 and the like, the length of the ion path from the opening (atmospheric pressure orifice) for taking ions from an ionization chamber having an atmospheric pressure atmosphere into a first intermediate vacuum chamber in a next stage to the ion incident surface of the ion detector is determined to 400 mm or less, and the inner diameter of the atmospheric pressure orifice is determined to 0.3 mm φ or less. The internal volumes of each intermediate vacuum chamber and the analysis chamber are also appropriately determined. By thus reducing the inner diameter of the atmospheric pressure orifice, it is possible to reduce the amount of air flowing from the ionization chamber to the first intermediate vacuum chamber. The volume of the first intermediate vacuum chamber itself is smaller than that of a conventional mass spectrometer. Hence, it is possible to reduce the evacuation speed of the vacuum pump (rotary pump) that evacuates the first intermediate vacuum chamber, and it is possible to use a small rotary pump. In fact, the devices described in Patent Literatures 1 and 2 use a small rotary pump having an evacuation speed of 10 $m^3$/Hr or less, which is equal to or less than half the evacuation speed of the rotary pump used in a conventional general mass spectrometer.

CITATION LIST

Patent Literature

Patent Literature 1: US 2016/0093480 A1
Patent Literature 2: US 2016/0111266 A1

Non Patent Literature

Non Patent Literature 1: "ACQUITY QDa Mass Detector", [online], Nihon Waters K. K., [Searched on Aug. 8, 2018], Internet

SUMMARY OF INVENTION

Technical Problem

However, the conventional small mass spectrometers disclosed in Patent Literatures 1 and 2 and the like have the following problems.

When the ion introduction opening (atmospheric pressure orifice) for introducing ions from the ionization chamber to the first intermediate vacuum chamber is made small in diameter, the capacity of the rotary pump can be reduced as described above, but it becomes highly possible that ions are made less likely to be introduced from the ionization chamber to the first intermediate vacuum chamber and that ions disappear while passing. Therefore, the amount of ions to be analyzed decreases, which may lead to reduction in detection sensitivity. In an atmospheric pressure ion source, minute sample droplets also tend to pass through the ion introduction opening, but the smaller in diameter the ion introduction opening is, the more likely they are clogged by them, which makes it less likely for ions to pass through, reduces the detection sensitivity, and destabilizes the detection output. In order to eliminate clogging of the ion introduction opening, maintenance such as cleaning should be conducted more frequently, which not only increases the cost of maintenance of the device but also increases the period during which the device cannot be used.

That is, the conventional small mass spectrometer was downsized sacrificing detection sensitivity and maintainability to some extent.

The present invention has been made to solve these problems, and its object is to provide a small mass spectrometer capable of reducing the size and floorspace of the device including the vacuum pump while maintaining performance and maintainability comparable to or close to those of a conventional general-sized mass spectrometer.

Solution to Problem

The simplest method that can be conceived to solve the above problems is to increase the area of the ion introduction opening for introducing ions from the ionization chamber into the first intermediate vacuum chamber in a downsized mass spectrometer as described in, for example, Patent Literatures 1 and 2 and the like. Since an increase in the area of the ion introduction opening increases the inflow amount of gas, it is of course necessary to raise the evacuation speed of the rotary pump in order to maintain the pressure in the first intermediate vacuum chamber at the same level as that when the area of the ion introduction opening is small. However, according to an experiment conducted by the present inventors, an adverse effect has been proved in which even if the area of the ion introduction opening is increased in a state where the pressure in the first intermediate vacuum chamber is substantially maintained, the ion intensity detected by the ion detector is reduced on the contrary.

Therefore, the present inventors repeated the experiment to investigate under what conditions the ion intensity increases. As a result, the present inventors have found that, in a case where the area of the ion introduction opening is large, compared with a case where the area of the ion introduction opening is small, the ion intensity becomes higher when the pressure in the first intermediate vacuum chamber is lower, and has found that by making the product of the opening area of the ion introduction opening and the pressure in the first intermediate vacuum chamber fall within a predetermined range, the ion intensity can be maximized or nearly maximized for the ion introduction opening of various opening areas. The present inventors have also found that the capacity (evacuation speed) of the vacuum pump for maintaining the pressure (vacuum) determined in accordance with such conditions was sufficiently lower than that of the vacuum pump used in conventional general mass spectrometers. The present inventors have come to the present invention on the basis of such findings and verification.

That is, a mass spectrometer according to a first aspect of the present invention made to solve the above problems includes:

an atmospheric pressure ion source configured to ionize a component in a liquid sample;

a first intermediate vacuum chamber disposed in a next stage of the atmospheric pressure ion source and evacuated by a first vacuum pump;

an ion guide disposed in the first intermediate vacuum chamber and configured to transport ions while converging them by an action of a high-frequency electric field;

a first opening for introducing ions generated in the atmospheric pressure ion source into the first intermediate vacuum chamber;

an analysis chamber having a high vacuum disposed in a stage behind the first intermediate vacuum chamber and evacuated by a second vacuum pump or both the second vacuum pump and the first vacuum pump;

a mass separator disposed in the analysis chamber and configured to separate an ion in accordance with its mass-to-charge ratio; and an ion detector disposed in the analysis chamber and configured to detect an ion separated by the mass separator, wherein an opening area of the first opening is equal to or greater than 0.071 $mm^2$, a product of an opening area of the first opening and pressure in the first intermediate vacuum chamber is within a range of 15 to 40 $mm^2 \cdot Pa$, and an evacuation speed of the first vacuum pump is equal to or less than 15 $m^3/Hr$.

The pressure in the first intermediate vacuum chamber is generally set so that the ion intensity detected by the ion detector is maximized as much as possible. However, in a case where downsizing is intended while suppressing the capacity of the vacuum pump that evacuates in the first intermediate vacuum chamber as described above, it is desirable to set the pressure in the first intermediate vacuum chamber to be a high state as long as the ion intensity is within a range equal to or greater than an acceptable threshold value even if the ion intensity becomes slightly lower than its maximum value.

Therefore, based on this point of view, a mass spectrometer according to a second aspect of the present invention made to solve the above problems includes:

an atmospheric pressure ion source configured to ionize a component in a liquid sample;

a first intermediate vacuum chamber disposed in a next stage of the atmospheric pressure ion source and evacuated by a first vacuum pump;

an ion guide disposed in the first intermediate vacuum chamber and configured to transport ions while converging them by an action of a high-frequency electric field;

a first opening for introducing ions generated in the atmospheric pressure ion source into the first intermediate vacuum chamber;

an analysis chamber having a high vacuum disposed in a stage behind the first intermediate vacuum chamber and evacuated by a second vacuum pump or both the second vacuum pump and the first vacuum pump;

a mass separator disposed in the analysis chamber and configured to separate an ion in accordance with its mass-to-charge ratio; and an ion detector disposed in the analysis chamber and configured to detect an ion separated by the mass separator, wherein an opening area of the first opening is equal to or greater than 0.071 $mm^2$, and pressure in the first intermediate vacuum chamber is higher than pressure when an ion intensity becomes maximal in relation between change in the pressure and an ion intensity in the ion detector, and is set to pressure at which the ion intensity is equal to or greater than 50% of the maximal value.

In the present invention, typically, the first vacuum pump for forming the first-stage vacuum region is a rotary pump, and the second vacuum pump for forming the subsequent vacuum region is a turbo-molecular pump having a lower reached pressure of vacuum evacuation.

In general, the rotary pump is connected to the mass spectrometer body via a pipe such as a hose. Thus, the rotary pump body is often installed at a position away from the space where the mass spectrometer body is installed. On the other hand, the turbo-molecular pump is directly connected to the mass spectrometer body and integrated with the mass spectrometer body. Thus, if the size of the turbo-molecular pump is large, a large space is required for installing the mass spectrometer. Therefore, in order to reduce the space for installing the mass spectrometer, it is desirable to minimize the size of the turbo-molecular pump as much as possible.

Based on this point of view, a mass spectrometer according to a third aspect of the present invention made to solve the above problems includes:

an atmospheric pressure ion source configured to ionize a component in a liquid sample;

a first intermediate vacuum chamber disposed in a next stage of the atmospheric pressure ion source and evacuated by a first vacuum pump via a pipe;

a second intermediate vacuum chamber disposed in a next stage of the first intermediate vacuum chamber and evacuated by a turbo-molecular pump via a first port of the turbo-molecular pump;

an analysis chamber disposed in a stage behind the second intermediate vacuum chamber and evacuated by the turbo-molecular pump via a second port of the turbo-molecular pump;

a mass separator disposed in the analysis chamber and configured to separate an ion in accordance with its mass-to-charge ratio;

an ion detector disposed in the analysis chamber and configured to detect an ion separated by the mass separator;

a first opening for introducing ions generated in the atmospheric pressure ion source into the first intermediate vacuum chamber;

a second opening for introducing, into the second intermediate vacuum chamber, ions having passed through the first intermediate vacuum chamber; and a third opening for introducing, into the analysis chamber, ions having passed through the second intermediate vacuum chamber, wherein an opening area of the first opening is equal to or greater than 0.125 $mm^2$, an opening area of the second opening is equal to or less than 0.8 $mm^2$, an opening area of the third opening is equal to or less than 0.8 $mm^2$, and an evacuation speed of the turbo-molecular pump is equal to or less than 100 L/sec.

The atmospheric pressure ion source in the present invention is, for example, an ion source using an ionization method such as the electrospray ionization, the atmospheric pressure chemical ionization, or the atmospheric pressure photoionization.

The first opening in the present invention is an opening of a narrow tube called a desolvation tube or a heating capillary, or an orifice formed at the apex of a substantially conical sampling cone. In a case where the first opening is an opening of a narrow tube, the opening area of the first opening is the area of the portion having the smallest cross-sectional area among the opening cross sections at each position along the longitudinal direction of the narrow tube (that is, the area of the narrowest portion for an ion to pass through). However, in a case where the cross-sectional area at each position along the longitudinal direction of the narrow tube is equal, the first opening is an opening on the ionization chamber side.

In the first and second aspects of the present invention, one or two intermediate vacuum chambers are normally provided between the first intermediate vacuum chamber and the analysis chamber, and in the third aspect of the present invention, two or more intermediate vacuum chambers are normally provided between the first intermediate vacuum chamber and the analysis chamber. Then, in these intermediate vacuum chambers, similarly in the first intermediate vacuum chamber, an ion guide that transports ions while converging them by the action of a high-frequency electric field is disposed.

In a case where the opening shape of the first opening is circular in the present invention, the diameter of the opening is larger than the diameter of the ion introduction opening (maximum 0.3 mm φ) in the above-described conventional small mass spectrometer. On the other hand, in the small mass spectrometer, the pressure in the first intermediate vacuum chamber is appropriately set so that a high ion intensity can be obtained even under the condition that the opening area of the first opening is relatively large. In the present invention, for example, in a case where the diameter of the circular first opening is 0.4 mm φ (opening area: 0.126 $mm^2$) and the product of the opening area of the first opening and the pressure in the first intermediate vacuum chamber is 30 $mm^2 \cdot Pa$, the first vacuum pump having a capacity of being capable of keeping the pressure in the first intermediate vacuum chamber at 239 Pa is only required to be used. The capacity of the first vacuum pump also depends on the volume of the first intermediate vacuum chamber, but in a mass spectrometer in which the size of the intermediate vacuum chamber or the analysis chamber is determined so that the length of the ion path from the first opening to the ion incident surface of the ion detector is 400 mm or less, for example, it is sufficient to use a small rotary pump having an evacuation speed of about 12 $m^3$/Hr.

In the mass spectrometer according to the first aspect of the present invention, the area of the first opening for introducing ions from the ionization chamber to the first intermediate vacuum chamber is made relatively large, and hence it is possible to suppress the capacity of the vacuum pump that evacuates the first intermediate vacuum chamber and downsize the mass spectrometer while ensuring a state in which the ion intensity in the ion detector is high.

In the mass spectrometer according to the second aspect of the present invention, the area of the first opening for introducing ions from the ionization chamber to the first intermediate vacuum chamber is made relatively large, and hence it is possible to minimize the pumping performance of the vacuum pump as much as possible under the condition where the ion intensity can be ensured to a certain degree or more. This can realize downsizing of the mass spectrometer including the vacuum pump while ensuring sufficient performance as the mass spectrometer.

Of course, the larger the opening area of the first opening is, the easier it becomes for ions to enter the first intermediate vacuum chamber through the opening, and the higher the introduction efficiency becomes. The risk of liquid samples sticking and clogging is also reduced. In the mass spectrometer according to the third aspect of the present invention, the area of the first opening for introducing ions from the ionization chamber to the first intermediate vacuum chamber is made further large, and hence it is possible to increase the introduction efficiency of ions to the first intermediate vacuum chamber, and improve the maintainability. On the other hand, since the opening areas of the second opening and the third opening positioned in the subsequent stage are made small, unnecessary gas inflow to the second intermediate vacuum chamber and the subsequent chambers can be suppressed. Therefore, in the mass spectrometer according to the third aspect of the present invention, it is possible to suppress the capacity of the turbo-molecular pump that evacuates the analysis chamber and downsize the mass spectrometer while ensuring a state in which the detection sensitivity in the ion detector is high.

Of course, also in the first and second aspects of the present invention, the opening area of the first opening is preferably 0.125 $mm^2$ or more.

On the other hand, the larger the opening area of the first opening is made, the lower the pressure in the first intermediate vacuum chamber needs to be, and the greater in evacuation speed the first vacuum pump and the second vacuum pump need to be. The upper limit of the opening diameter of the first opening is 0.8 to 1.0 mm φ (opening area: 0.5 to 0.79 $mm^2$) at most, which is used in a conventional general mass spectrometer, but in practice, the upper limit can be restricted to a further smaller value by the evacuation speed of the first vacuum pump and the second vacuum pump.

In the present invention, the ion guide forms an ion passage space in which an ion proceeds by a plurality of electrodes disposed so as to surround an ion optical axis, and the area of a cross section orthogonal to the ion optical axis in the ion passage space becomes smaller as an ion proceeds, and the opening area of the second opening for sending the ion from the first intermediate vacuum chamber to the next stage is preferably 0.8 $mm^2$ or less.

By making the shape of the ion passage space of the ion guide as described above, it is possible to adequately converge ions which otherwise tend to expand due to the space charge effect, and efficiently send them to the second intermediate vacuum chamber in the next stage through the second opening having a small diameter. On the other hand, by making the opening area of the second opening 0.8 $mm^2$ or less, it is possible to reduce the amount of gas flowing from the first intermediate vacuum chamber to the second intermediate vacuum chamber in the next stage, and it is possible to reduce the load of the second vacuum pump (or both the first vacuum pump and the second vacuum pump) that evacuates the second intermediate vacuum chamber. As a result, the second vacuum pump can be downsized.

Specifically, for example, the ion guide can be configured to be a plurality of rod-like electrodes disposed so as to surround the ion optical axis, or a plurality of virtual rod-like electrodes where each of them includes a plurality of electrodes divided in the extension direction of the ion optical axis. Alternatively, as the ion guide, it is also possible to use an ion funnel having a structure in which a plurality of disk-like electrodes having a circular opening in the center are disposed in the extension direction of the ion optical axis.

Similarly to the third aspect of the present invention, in the first and second aspects, the mass spectrometer may have a configuration in which the second intermediate vacuum chamber is provided between the first intermediate vacuum chamber and the analysis chamber, a multipole ion guide that transports ions while converging them by the action of a high-frequency electric field is disposed in the second intermediate vacuum chamber, and the opening area of the third opening between the second intermediate vacuum chamber and the analysis chamber is 0.8 $mm^2$ or less.

As the multipole ion guide, it is preferable to use a quadrupole ion guide having a high ion convergence effect. Thus, it is possible to cause ions to well converge also in the second intermediate vacuum chamber, and efficiently send them to, for example, the analysis chamber in the next stage through the third opening having a small diameter. On the other hand, by making the opening area of the third opening 0.8 $mm^2$ or less, it is possible to reduce the amount of gas flowing from the second intermediate vacuum chamber to the analysis chamber in the next stage, and it is possible to reduce the load of the second vacuum pump (or both the first vacuum pump and the second vacuum pump) that evacuates the analysis chamber. As a result, the second vacuum pump can be downsized.

Advantageous Effects of Invention

According to the mass spectrometer according to the present invention, it is possible to downsize the mass spectrometer while increasing the area of the ion introduction opening for introducing ions from the atmospheric pressure ion source into the first intermediate vacuum chamber as compared with the conventional small mass spectrometer, ensuring sufficiently high ion intensity, and maintaining high maintainability. Thus, it is possible to save the space when the device is installed. As a result, for example, in a case of using the mass spectrometer according to the present invention as a detector of LC-MS, it becomes possible to easily replace a detector of another method with the mass spectrometer according to the present invention.

DESCRIPTION OF EMBODIMENTS

A mass spectrometer of an example of the present invention will be described below with reference to the accompanying drawings.

Figure 1:
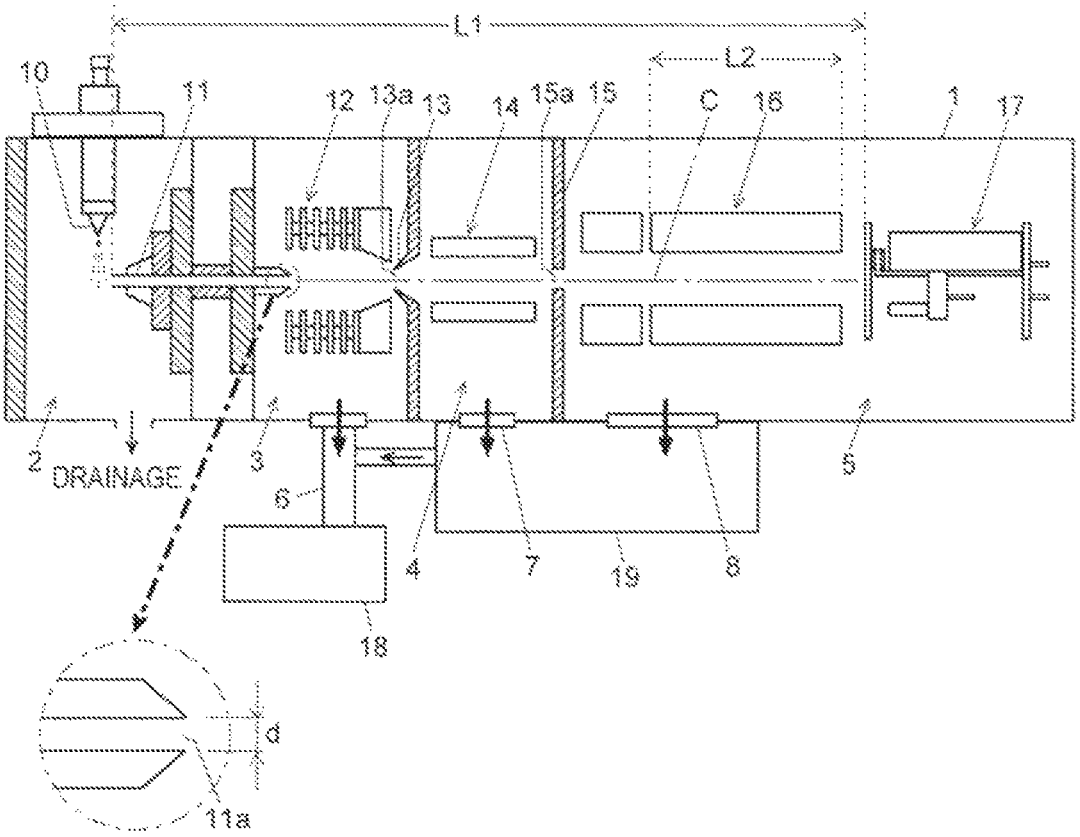
FIG. 1 is a schematic diagram of a mass spectrometer of an example of the present invention.

FIG. 1 is a schematic diagram of the mass spectrometer of the present example centering on the ion path. As a matter of course, since FIG. 1 is a schematic configuration diagram, the size of each component, the interval and distance between different components, and the like in the diagram do not necessarily reflect the actual device.

The mass spectrometer of the present example has an ionization chamber 2 for ionizing a component (compound) in a liquid sample under a substantially atmospheric pressure in a casing 1, and an analysis chamber 5 maintained in a high vacuum for mass-separating and detecting ions derived from a sample component, and has, between the ionization chamber 2 and the analysis chamber 5, a first intermediate vacuum chamber 3 and a second intermediate vacuum chamber 4 in which a degree of vacuum is increased in a stepwise manner. The first intermediate vacuum chamber 3 is connected to a rotary pump (RP) 18 via a pipe 6 such as a polyvinyl chloride (PVC) hose having a length of about 1 m, and is evacuated by the rotary pump 18. On the other hand, the second intermediate vacuum chamber 4 and the analysis chamber 5 are directly connected to a first port 7 and a second port 8 of a turbo-molecular pump (TMP) 19, respectively, and are evacuated by both the rotary pump 18 and the turbo-molecular pump (TMP) 19. That is, this mass spectrometer has a configuration of a multi-stage differential evacuation system, whereby the inside of the analysis chamber 5, which is the final stage, is maintained to a high degree of vacuum.

In the ionization chamber 2, an electrospray ionization (ESI) probe 10 configured to ionize a component in a liquid sample by electrostatically nebulizing the sample is disposed. The ionization chamber 2 and the first intermediate vacuum chamber 3 communicate with each other through a desolvation tube 11, which is a capillary tube heated to an appropriate temperature. Here, the nebulization direction of the droplet by the ESI probe 10 and the ion suction direction by the desolvation tube 11 are in a relationship of substantially orthogonal to each other, but they may not necessarily be orthogonal to each other.

In the first intermediate vacuum chamber 3, a Q array ion guide 12 which transports ions while converging them by an action of a high-frequency electric field is disposed. This Q array ion guide 12 has a configuration in which four virtual rod-like electrodes are disposed so as to surround an ion optical axis C, and one virtual rod-like electrode includes a plurality of electrodes divided in the extension direction of the ion optical axis C. A space surrounded by the virtual rod-like electrodes in the Q array ion guide 12 gradually narrows in the ion travel direction.

The first intermediate vacuum chamber 3 and the second intermediate vacuum chamber 4 communicate with each other through a minute ion passage hole (orifice) 13*a* formed at the apex of a substantially conical skimmer 13. In the second intermediate vacuum chamber 4, a quadrupole ion guide 14 which transports ions while converging them by an action of a high-frequency electric field is disposed. This quadrupole ion guide 14 includes four rod electrodes disposed parallel to the ion optical axis so as to surround the ion optical axis. The second intermediate vacuum chamber 4 and the analysis chamber 5 communicate with each other through a minute ion passage hole 15*a* formed in a flat aperture electrode 15.

In the analysis chamber 5, a quadrupole mass filter 16 as a mass separator and an ion detector 17 are disposed. The quadrupole mass filter 16 has a configuration in which four rod electrodes extending parallel to the ion optical axis C are disposed around the ion optical axis C. A prefilter including four rod electrodes shorter than the rod electrodes constituting the quadrupole mass filter 16 is disposed in front of the quadrupole mass filter 16 along the ion traveling direction. The ion detector 17 includes, for example, a conversion dynode and a secondary electron multiplier tube.

A direct-current voltage or a voltage obtained by adding a high-frequency voltage and a direct-current voltage is applied from a power supply not shown to the desolvation tube 11, the Q array ion guide 12, the skimmer 13, the quadrupole ion guide 14, the aperture electrode 15, the quadrupole mass filter 16, and the ion detector 17 respectively, arranged along the ion optical axis C. A predetermined direct-current voltage is also applied to the ESI probe 10.

A general analysis operation in the mass spectrometer of the present example will be briefly described.

For example, when a liquid sample eluted from an LC column not shown is introduced into the ESI probe 10, a charge is given to the liquid sample at the tip of the probe 10, and the liquid sample is nebulized into the ionization chamber 2 as a minute charged droplet. In the ionization chamber 2, the solvent in the charged droplet evaporates while the charged droplet is brought into contact with the surrounding air to become fine. In the process, the sample component in the droplet is discharged with a charge, and ions derived from the sample component are generated. Since there is a pressure difference between the inlet end and the outlet end of the desolvation tube 11, a gas flow flowing from the ionization chamber 2 side to the first intermediate vacuum chamber 3 is formed in the desolvation tube 11. Therefore, as described above, the ions generated in the ionization chamber 2 are sucked into the desolvation tube 11 and sent into the first intermediate vacuum chamber 3. At this time, a part of the fine charged droplets is also sucked into the desolvation tube 11, but since the desolvation tube 11 is appropriately heated, the evaporation of the solvent is accelerated while the charged droplets pass through the desolvation tube 11, and the generation of ions progresses.

The ion entering the first intermediate vacuum chamber 3 on the gas flow is appropriately cooled by coming into contact with the residual gas, and proceeds while being captured by the high-frequency electric field formed by the Q array ion guide 12. This ion converges near an ion passage hole 13*a* at the apex of the skimmer 13, and is sent to the second intermediate vacuum chamber 4 through the ion passage hole 13*a*. The ion entering the second intermediate vacuum chamber 4 is captured by the high-frequency electric field formed by the quadrupole ion guide 14 and proceeds while converging near the ion optical axis C. Then, the ion is sent to the analysis chamber 5 through the ion passage hole 15*a* formed in the aperture electrode 15.

In the analysis chamber 5, ions are introduced to the quadrupole mass filter 16 through the prefilter. The prefilter is to correct disturbance of the electric field formed near the leading edge of the rod electrode of the quadrupole mass filter 16, whereby the ions are smoothly and efficiently introduced into the quadrupole mass filter 16. A voltage obtained by superimposing a high-frequency voltage on a direct-current voltage is applied to each rod electrode of the quadrupole mass filter 16, and only ions having a specific mass-to-charge ratio corresponding to the voltages pass through the quadrupole mass filter 16 and reach the ion detector 17. The ion detector 17 generates an ion intensity signal having an intensity corresponding to the amount of reached ions, and sends this signal to a data processing unit not shown.

By changing the direct-current voltage and the high-frequency voltage applied to each rod electrode of the quadrupole mass filter 16 while maintaining a predetermined relationship, the mass-to-charge ratio of ions that can pass through the quadrupole mass filter 16 changes. Thus, mass-to-charge ratio scanning over a predetermined mass-to-charge ratio range is performed, and it is possible to obtain a mass spectrum (profile spectrum) indicating a change in the ion intensity signal over the mass-to-charge ratio range.

Next, a characteristic configuration of the mass spectrometer of the present example will be described. The mass spectrometer of the present example is smaller than the conventional general quadrupole mass spectrometer, and various measures have been taken to realize downsizing while ensuring sufficient performance.

As described above, the ions to be measured, which are derived from a sample component generated in the ionization chamber 2, pass through each component from the desolvation tube 11 and finally reach the ion detector 17. Therefore, in order to downsize the device, it is necessary to shorten as much as possible the length of an ion path L1, which is a linear space from the opening (that is, the ion inlet opening) of the desolvation tube 11 facing the ionization chamber 2 to the ion incident surface of the ion detector 17. For this purpose, it is necessary to shorten the lengths of the Q array ion guide 12, the quadrupole ion guide 14, and the quadrupole mass filter 16. However, in a general quadrupole mass spectrometer, the length of the rod electrode of the quadrupole mass filter 16 is 200 mm or more, meanwhile the lengths of the Q array ion guide 12 and the quadrupole ion guide 14, which are ion guides positioned on the upstream side of the quadrupole mass filter 16, are 100 mm or less, which is originally relatively short. Therefore, even if the lengths of the Q array ion guide 12 and the quadrupole ion guide 14 are further shortened, the effect on the downsizing of the device is small, and there is a possibility that the device sensitivity is unacceptably lowered. Therefore, in the mass spectrometer of the present example, the length of each component forming the ion path L1 is shortened as much as possible, and in particular, a length L2 of the rod electrode of the quadrupole mass filter 16, whose ratio to the length of the ion path L1 is relatively large, is made significantly shorter than that of a general quadrupole mass spectrometer.

Specifically, the length L2 of the rod electrode of the quadrupole mass filter 16 is 200 mm or more in a conventional general quadrupole mass spectrometer, but in a case where the length L1 of the ion path is 400 mm or less, the length L2 of the rod electrode is 150 mm or less, more preferably 120 mm or less. In the mass spectrometer of the present example, the length L2 of the rod electrode is 100 mm. An ion introduced into the quadrupole mass filter 16 oscillates in the radial direction by an action of a high-frequency electric field while passing through a space surrounded by four rod electrodes, and the mass separation performance depends on the number of oscillations. Therefore, the mass separation performance is reduced when the number of oscillations of ion decreases by shortening the rod electrode. On the other hand, in the mass spectrometer of the present example, by appropriately adjusting the voltage applied to the rod electrodes, specifically, the direct-current bias voltage commonly applied to the four rod electrodes constituting the quadrupole mass filter 16, the number of oscillations of ion is maintained at the same level as that of the conventional mass spectrometer, and sufficient mass separation performance is maintained.

In the mass spectrometer of the present example, the cross-sectional opening shape of the desolvation tube 11 is circular, and its inner diameter d is constant at 0.4 mm φ regardless of the position in the ion passing direction. That is, the inner diameter d of the first opening in the present invention is 0.4 mm φ, and its opening area is 0.126 $mm^2$. This is larger than the inner diameter of the atmospheric pressure orifice in the conventional small mass spectrometer disclosed in Patent Literatures 1 and 2 and the like.

Ions derived from a sample component generated in the ionization chamber 2 are taken into the desolvation tube 11 not by being converged by the high-frequency electric field but by the gas flow formed by a pressure difference as described above. Here, it is known that the flow rate of the gas flowing in from the desolvation tube 11 is proportional to the fourth power of the radius of the opening in a case where the desolvation tube 11 has a circular opening. Therefore, a slight difference in the inner diameter appears as a large difference in the gas flow rate. For example, in a case where the inner diameter of the opening of the desolvation tube 11 is 0.4 mm φ, the flow rate of the gas is about three times as large as that in a case where the inner diameter is 0.3 mm φ. An increase in the gas flow rate leads to an increase in the ion introduction amount. Therefore, the inner diameter (that is, the inner diameter of the first opening) d of the desolvation tube 11 or its opening area influences the introduction efficiency of ions from the ionization chamber 2 into the first intermediate vacuum chamber 3, and it is preferable that the inner diameter d be large in order to increase the ion introduction amount. The larger the inner diameter d is, the less likely the sample droplets are clogged, and the higher the maintainability is. However, when the inner diameter d increases, the gas inflow amount from the ionization chamber 2 into the first intermediate vacuum chamber 3 also increases, and hence, in order to make the pressure in the first intermediate vacuum chamber 3 similar to that in the case where the inner diameter d is small, it is necessary to increase the capacity of the rotary pump 18.

Figure 2:
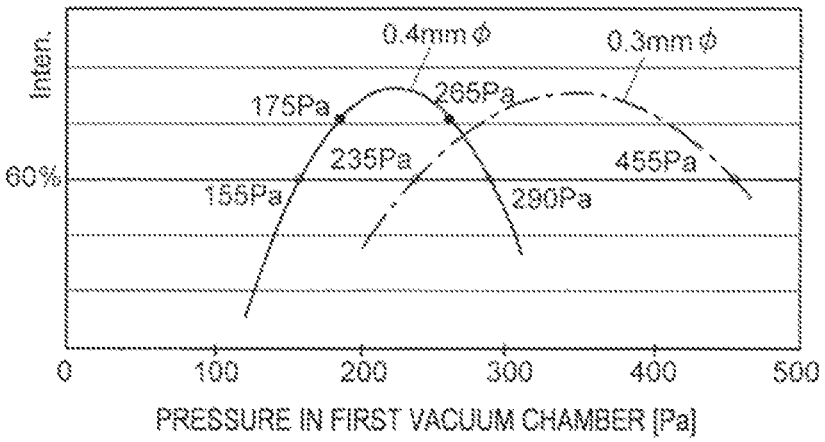
FIG. 2 is a graph showing a measured result of the relationship between the pressure in the first intermediate vacuum chamber and the ion intensity detected by the ion detector when the inner diameters of the desolvation tubes (ion introduction openings) are different.

On the other hand, the ion is captured by the high-frequency electric field by using the cooling action of the ion by the residual gas in the first intermediate vacuum chamber 3 as described above, and therefore it is not necessarily true that the lower the pressure is, the better it is in terms of the passage efficiency of the ion. Therefore, the present inventors experimentally examined the relationship between the pressure in the first intermediate vacuum chamber and the ion intensity detected by the ion detector in two cases of a case where the inner diameter of the desolvation tube 11 is 0.4 mm φ and a case where the inner diameter of the desolvation tube 11 is 0.3 mm φ. FIG. 2 is a graph showing a measured result of the change in ion intensity when the pressure in the first intermediate vacuum chamber is changed.

FIG. 2 indicates that the relationship between the pressure and the ion intensity has a convex upward peak shape in any of the inner diameters d and the larger the inner diameter d is, the lower the pressure range in which the peak of the ion intensity appears is (that is, the vacuum is high). That is, the smaller the inner diameter of the desolvation tube 11 is, the higher the optimum pressure is compared with the larger one. This result has the consequence that by setting the pressure so that the product of the inner diameter of the first opening, i.e., its opening area, and the pressure in the first intermediate vacuum chamber falls within a predetermined range, sufficient ion intensity can be obtained regardless of the inner diameter of the first opening.

Specifically, according to the result of FIG. 2, when the inner diameter d of the desolvation tube 11 is 0.4 mm φ, a desired level of ion intensity (here, intensity of 60% or more of the peak intensity) can be obtained by setting the pressure in the first intermediate vacuum chamber 3 within the range of 155 Pa to 290 Pa. In this case, the opening area×pressure becomes in the range of 19.5 to 36.4 $mm^2$·Pa. On the other hand, when the inner diameter d of the desolvation tube 11 is 0.3 mm φ, a desired level of ion intensity can be obtained by setting the pressure in the first intermediate vacuum chamber 3 within the range of 235 Pa to 455 Pa. In this case, the opening area x pressure becomes in the range of 16.6 to 32.1 $mm^2$·Pa. In reality, it is acceptable as long as an ion intensity at a level of about half or more of the peak intensity is obtained. Hence, even if the opening area is desired to be larger than the opening area of the first opening used in a conventional small mass spectrometer, the product of the opening area and the pressure in the first intermediate vacuum chamber is only required to fall within a range of about 15 to 40 $mm^2$·Pa.

However, in a case where the inner diameter of the desolvation tube 11 has changed due to maintenance involving component replacement or in a case where the evacuation speed of the rotary pump has changed due to fluctuations in the power supply voltage, the pressure in the first intermediate vacuum chamber 3 may change, and the ion intensity may change. Therefore, it is desirable that the product of the opening area of the first opening and the pressure in the first intermediate vacuum chamber 3 be set so that the change in ion intensity at the time of pressure change becomes small. According to the result of FIG. 2, when the inner diameter d of the desolvation tube 11 is 0.4 mm φ, by setting the pressure in the first intermediate vacuum chamber 3 within the pressure range around 215 Pa, where the ion intensity shows a maximum, e.g., within the range of 175 to 265 Pa, it is possible to reduce the change in ion intensity at the time of pressure change while achieving a higher ion intensity than that in a case of setting the pressure in another pressure range. In this case, the product of the opening area of the first opening and the pressure in the first intermediate vacuum chamber 3 is only required to fall within a range of 20 to 35 $mm^2 \cdot Pa$.

Now, assuming a case where the desolvation tube 11 having an inner diameter of 0.4 mm φ, which is a larger opening area than that used in a conventional small mass spectrometer is used and the opening area×pressure is kept within the above range of 30 $mm^2 \cdot Pa$, a rotary pump having a capacity capable of maintaining the pressure in the first intermediate vacuum chamber 3 at 239 Pa is required. The actually required capacity of the rotary pump depends also on the internal volume of the first intermediate vacuum chamber 3, but in the mass spectrometer of the present example, the ion path is short as described above, and the internal volume of the first intermediate vacuum chamber 3 is small as compared with a conventional general mass spectrometer. Hence, the pressure described above can be realized by using a relatively small rotary pump having an evacuation speed of about 12 $m^3$/Hr. A conventional general mass spectrometer requires a rotary pump having an evacuation speed of about 25 to 30 $m^3$/Hr or more. On the other hand, since the mass spectrometer of the present example is only required to use the rotary pump 18 having an evacuation speed of about half or less, the rotary pump 18 is considerably small in size.

Figure 3:
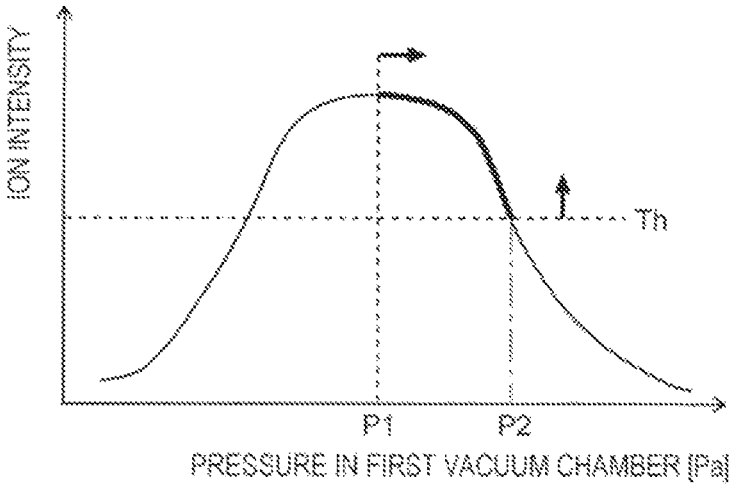
FIG. 3 is a chart showing a range of pressure in the first intermediate vacuum chamber set by the mass spectrometer of the present example in relation between the pressure in the first intermediate vacuum chamber and the ion intensity.

For example, in a case where the acceptable level of ion intensity is set to 50% or 60% of the peak intensity, the range of the pressure in the first intermediate vacuum chamber 3 capable of realizing this is considerably wide, but from the viewpoint of using the rotary pump 18 as small as possible, it is preferable to keep the pressure within a range higher than P1 and equal to or less than P2 shown in FIG. 3. Thus, even if the ion intensity is at the same level, the evacuation speed of the rotary pump 18 can be suppressed to be further lower, which is advantageous for downsizing of the rotary pump 18.

In the mass spectrometer of the present example, the virtual rod-like electrode constituting the Q array ion guide 12 is tapered so as to approach the ion optical axis C as the ion proceeds. The radius of the substantially circular ion outlet region at the rearmost end of the Q array ion guide 12 is 2.0 mm φ or less. On the other hand, the circular ion passage hole 13*a* formed in the skimmer 13 has an inner diameter of 0.8 mm φ (opening area: 0.5 $mm^2$), which is a very small diameter of 1.0 mm φ (opening area: 0.79 $mm^2$) or less. By providing the Q array ion guide 12 with the structure described above, it is possible to cause the ions captured by the high-frequency electric field to converge in a small region on the ion optical axis C. This can cause ions to efficiently pass through the ion passage hole 13*a* even if the inner diameter of the ion passage hole 13*a* is made small. Since the inner diameter of the ion passage hole 13*a* is small, i.e., the opening area is small, it is possible to reduce the inflow amount of gas from the first intermediate vacuum chamber 3 to the second intermediate vacuum chamber 4, and it is possible to reduce the load of the turbo-molecular pump 19 that evacuates the second intermediate vacuum chamber 4 and the analysis chamber 5.

Here, the ion guide disposed in the first intermediate vacuum chamber 3 is not limited to the Q array ion guide, and may be a similarly tapered multipole RF ion guide. Alternatively, the ion guide disposed in the first intermediate vacuum chamber 3 may be an ion funnel ion guide in which a large number of disk-like electrodes having a circular opening at the center are arranged at narrow intervals along the ion optical axis C and the opening area at the center of each electrode is gradually reduced toward the outlet. However, in the case of such an ion funnel structure, since the distance between adjacent electrodes is as very close as about 1 mm, it is highly likely that neutral particles and ions collide with the electrodes. On the other hand, in the case of a Q array ion guide or a multipole RF ion guide using a rod electrode, since the distance between adjacent electrodes is relatively large, it is less likely that neutral particles and ions collide with the electrodes. Therefore, the Q array ion guide or the multipole RF ion guide are more advantageous than the ion funnel ion guide in terms of durability.

In the mass spectrometer of the present example, since the opening area of the desolvation tube 11 corresponding to the first opening in the present invention is larger than that of the conventional small mass spectrometer, it is possible to reduce the risk of clogging of the first opening, but the possibility of contamination of the ion guide on its downstream side becomes relatively high. With respect to such risk, for the reason described above, a configuration in which a Q array ion guide or a multipole RF ion guide having high durability against contamination is employed as the ion guide of the first intermediate vacuum chamber is more preferable.

In the mass spectrometer of the present example, the inner diameter of the ion passage hole 15*a* formed in the aperture electrode 15 is also a small diameter less than 1.0 mm φ (opening area: 0.79 $mm^2$). The quadrupole ion guide 14 is higher in ion convergence effect than a multipole ion guide having a larger number of poles such as an octopole ion guide. This can cause the ion captured by the high-frequency electric field to converge in a small region on the ion optical axis C. This can cause the ion to efficiently pass through the ion passage hole 15*a* even if the inner diameter of the ion passage hole 15*a* is reduced. Since the inner diameter of the ion passage hole 15*a* is small, i.e., the opening area is small, it is possible to reduce the inflow amount of gas from the second intermediate vacuum chamber 4 to the analysis chamber 5. This can reduce the load of the vacuum pump (turbo-molecular pump 19) that evacuates the analysis chamber 5, and can further reduce the pressure in the analysis chamber 5, where the quadrupole mass filter 16 is disposed. As a result, the passing efficiency and mass resolution of ions in the quadrupole mass filter 16 can be improved.

Specifically, by reducing the opening areas of the two ion passage holes 13*a* and 15*a* as described above, the evacuation speed of the turbo-molecular pump 19 can be suppressed to 100 L/sec or less. In a conventional general mass spectrometer, the evacuation speed of the turbo-molecular pump is about 200 to 300 L/sec. On the other hand, in the mass spectrometer of the present example, the evacuation speed of the turbo-molecular pump is less than half that, and hence it is possible to use a small turbo-molecular pump, and it is possible to keep the device compact even when integrating the turbo-molecular pump with the device body.

As described above, the rotary pump 18 is connected to the first intermediate vacuum chamber 3 via the pipe 6 having a length of about 1 m. Therefore, in a case of installing the mass spectrometer body on the laboratory table, the rotary pump 18 can be accommodated, for example, in a space under the laboratory table, and the size of the rotary pump is often not substantially a problem to the user. On the other hand, as shown also in FIG. 1, since the turbo-molecular pump is directly connected to the vacuum chamber forming the analysis chamber, the turbo-molecular pump is substantially integrated with the mass spectrometer body, and this is a factor that increases the volume of the mass spectrometer body installed on the laboratory table. On the other hand, according to the configuration of the present example, it is advantageous in that a small turbo-molecular pump having a relatively small evacuation speed can be used, and the size of a substantial device can be reduced.

As described above, the mass spectrometer of the present example can achieve downsizing of the device including the rotary pump 18 and the turbo-molecular pump 19 while maintaining high detection sensitivity and good maintenance.

In the mass spectrometer of the above example, the inner diameter of the desolvation tube 11 is constant in the axial direction, but the shape and structure of the ion introduction opening for introducing ions from the ionization chamber 2 into the first intermediate vacuum chamber 3 vary. Since the first opening in the present invention is a portion for restricting the ion amount when introducing ions from the ionization chamber 2 into the first intermediate vacuum chamber 3, the inner diameter or opening area of the first opening is only required to be defined as follows.

Figure 4A:
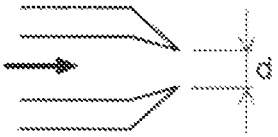
FIGS. 4A to 4C are views showing another example of an opening separating the ionization chamber from the first intermediate vacuum chamber.
Figure 4B:
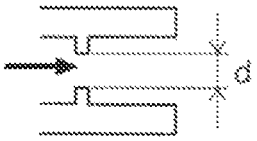
Figure 4C:
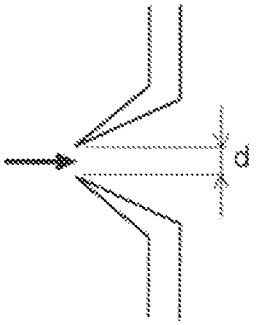

For example, as shown in FIG. 4A, in a case where the outlet end (opening facing the first intermediate vacuum chamber 3) of the desolvation tube 11 is narrowed, the inner diameter or opening area of the tip end opening corresponds to the inner diameter or opening area of the first opening. As shown in FIG. 4B, in a case where the inner diameter is narrowed in the middle of the pipe line of the desolvation tube 11, the inner diameter or opening area of the cross-sectional opening in the narrowed portion corresponds to the inner diameter or opening area of the first opening. Furthermore, as shown in FIG. 4C, in a case where the ionization chamber and the first intermediate vacuum chamber communicate with each other through an orifice provided at the top of the sampling cone (for example, there is also a case of a sampling cone having two stages), the inner diameter or opening area of the orifice corresponds to the inner diameter or opening area of the first opening.

In the mass spectrometer of the above example, the atmospheric pressure ion source adopts the ESI method, but an atmospheric pressure ion source may adopt the APCI method, the APPI method, or the like.

Moreover, since the above example is an example of the present invention, it is obvious that modification, addition, and correction made appropriately within the scope of the purpose of the present invention to points other than the above description are included in the scope of the claims of the present invention.

REFERENCE SIGNS LIST

1 . . . Casing
2 . . . Ionization Chamber
3 . . . First Intermediate Vacuum Chamber
4 . . . Second Intermediate Vacuum Chamber
5 . . . Analysis Chamber
10 . . . ESI Probe
11 . . . Desolvation Tube
11*a* . . . Ion Outlet Opening
12 . . . Q Array Ion Guide
13 . . . Skimmer
13*a* . . . Ion Passage Hole
14 . . . Quadrupole Ion Guide
15 . . . Aperture Electrode
15*a* . . . Ion Passage Hole
16 . . . Quadrupole Mass Filter
17 . . . Ion Detector
18 . . . Rotary Pump
19 . . . Turbo-Molecular Pump
C . . . Ion Optical Axis

The invention claimed is:

1. A mass spectrometer comprising:

an atmospheric pressure ion source configured to ionize a component in a liquid sample;

a first intermediate vacuum chamber disposed in a next stage of the atmospheric pressure ion source and evacuated by a first vacuum pump;

an ion guide disposed in the first intermediate vacuum chamber and configured to transport ions while converging them by an action of a high-frequency electric field;

a first opening for introducing ions generated in the atmospheric pressure ion source into the first intermediate vacuum chamber;

an analysis chamber having a high vacuum disposed in a stage behind the first intermediate vacuum chamber and evacuated by a second vacuum pump or both the second vacuum pump and the first vacuum pump;

a mass separator disposed in the analysis chamber and configured to separate an ion in accordance with its mass-to-charge ratio; and an ion detector disposed in the analysis chamber and configured to detect an ion separated by the mass separator, wherein an opening area of the first opening is equal to or greater than 0.071 $mm^2$, a product of an opening area of the first opening and pressure in the first intermediate vacuum chamber is within a range of 15 to 40 $mm^2 \cdot Pa$, and an evacuation speed of the first vacuum pump is equal to or less than 15 $m^3/Hr$.

2. A mass spectrometer comprising:

an atmospheric pressure ion source configured to ionize a component in a liquid sample;

a first intermediate vacuum chamber disposed in a next stage of the atmospheric pressure ion source and evacuated by a first vacuum pump;

an ion guide disposed in the first intermediate vacuum chamber and configured to transport ions while converging them by an action of a high-frequency electric field;

a first opening for introducing ions generated in the atmospheric pressure ion source into the first intermediate vacuum chamber;

an analysis chamber having a high vacuum disposed in a stage behind the first intermediate vacuum chamber and evacuated by a second vacuum pump or both the second vacuum pump and the first vacuum pump;

a mass separator disposed in the analysis chamber and configured to separate an ion in accordance with its mass-to-charge ratio; and an ion detector disposed in the analysis chamber and configured to detect an ion separated by the mass separator, wherein an opening area of the first opening is equal to or greater than 0.071 $mm^2$, and pressure in the first intermediate vacuum chamber is higher than pressure when an ion intensity becomes maximal in relation between change in the pressure and an ion intensity in the ion detector, and is set to pressure at which the ion intensity is equal to or greater than 50% of the maximal value.

3. A mass spectrometer comprising:

an atmospheric pressure ion source configured to ionize a component in a liquid sample;

a first intermediate vacuum chamber disposed in a next stage of the atmospheric pressure ion source and evacuated by a first vacuum pump via a pipe;

a second intermediate vacuum chamber disposed in a next stage of the first intermediate vacuum chamber and evacuated by a turbo-molecular pump via a first port of the turbo-molecular pump;

an analysis chamber disposed in a stage behind the second intermediate vacuum chamber and evacuated by the turbo-molecular pump via a second port of the turbo-molecular pump;

a mass separator disposed in the analysis chamber and configured to separate an ion in accordance with its mass-to-charge ratio;

an ion detector disposed in the analysis chamber and configured to detect an ion separated by the mass separator;

a first opening for introducing ions generated in the atmospheric pressure ion source into the first intermediate vacuum chamber;

a second opening for introducing, into the second intermediate vacuum chamber, ions having passed through the first intermediate vacuum chamber; and a third opening for introducing, into the analysis chamber, ions having passed through the second intermediate vacuum chamber, wherein an opening area of the first opening is equal to or greater than 0.125 $mm^2$, an opening area of the second opening is equal to or less than 0.8 $mm^2$, an opening area of the third opening is equal to or less than 0.8 $mm^2$, and an evacuation speed of the turbo-molecular pump is equal to or less than 100 $m^3$/Hr.

4. The mass spectrometer according to claim 1, wherein a product of an opening area of the first opening and pressure in the first intermediate vacuum chamber is within a range of 20 to 35 $mm^2 \cdot Pa$.

5. The mass spectrometer according to claim 1, wherein an opening area of the first opening is equal to or greater than 0.125 $mm^2$.

6. The mass spectrometer according to claim 1, wherein the mass separator includes four rod electrodes, and a length of the rod electrode is equal to or less than 120 mm.

7. The mass spectrometer according to claim 1, wherein the ion guide forms an ion passage space in which an ion proceeds by a plurality of electrodes disposed so as to surround an ion optical axis, and an area of a cross section orthogonal to an ion optical axis in the ion passage space becomes smaller as an ion proceeds, and an opening area of a second opening, which is an ion outlet from the first intermediate vacuum chamber, is equal to or less than 0.8 $mm^2$.

8. The mass spectrometer according to claim 7, wherein the ion guide is a plurality of rod-like electrodes disposed so as to surround an ion optical axis, or a plurality of virtual rod-like electrodes where each of them includes a plurality of electrodes divided in an extension direction of an ion optical axis.

9. The mass spectrometer according to claim 1, wherein a second intermediate vacuum chamber is provided between the first intermediate vacuum chamber and the analysis chamber, a quadrupole ion guide configured to transport ions while converging them by an action of a high-frequency electric field is disposed in the second intermediate vacuum chamber, and an opening area of a third opening between the second intermediate vacuum chamber and the analysis chamber is equal to or less than 0.8 $mm^2$.

10. The mass spectrometer according to claim 2, wherein an opening area of the first opening is equal to or greater than 0.125 $mm^2$.

11. The mass spectrometer according to claim 2, wherein the mass separator includes four rod electrodes, and a length of the rod electrode is equal to or less than 120 mm.

12. The mass spectrometer according to claim 2, wherein the ion guide forms an ion passage space in which an ion proceeds by a plurality of electrodes disposed so as to surround an ion optical axis, and an area of a cross section orthogonal to an ion optical axis in the ion passage space becomes smaller as an ion proceeds, and an opening area of a second opening, which is an ion outlet from the first intermediate vacuum chamber, is equal to or less than 0.8 $mm^2$.

13. The mass spectrometer according to claim 12, wherein the ion guide is a plurality of rod-like electrodes disposed so as to surround an ion optical axis, or a plurality of virtual rod-like electrodes where each of them includes a plurality of electrodes divided in an extension direction of an ion optical axis.

14. The mass spectrometer according to claim 2, wherein a second intermediate vacuum chamber is provided between the first intermediate vacuum chamber and the analysis chamber, a quadrupole ion guide configured to transport ions while converging them by an action of a high-frequency electric field is disposed in the second intermediate vacuum chamber, and an opening area of a third opening between the second intermediate vacuum chamber and the analysis chamber is equal to or less than 0.8 $mm^2$.

15. The mass spectrometer according to claim 3, wherein a first ion guide configured to transport ions while converging them by an action of a high-frequency electric field is disposed in the first intermediate vacuum chamber, and the first ion guide forms an ion passage space in which an ion proceeds by a plurality of electrodes disposed so as to surround an ion optical axis, and an area of a cross section orthogonal to an ion optical axis in the ion passage space becomes smaller as an ion proceeds.

16. The mass spectrometer according to claim 15, wherein the first ion guide is a plurality of rod-like electrodes disposed so as to surround an ion optical axis, or a plurality of virtual rod-like electrodes where each of them includes a plurality of electrodes divided in an extension direction of an ion optical axis.

17. The mass spectrometer according to claim 3, wherein a quadrupole ion guide configured to transport ions while converging them by an action of a high-frequency electric field is disposed in the second intermediate vacuum chamber.

18. The mass spectrometer according to claim 3, wherein the mass separator includes four rod electrodes, and a length of the rod electrode is equal to or less than 120 mm.

* * * * *